US005991959A

United States Patent [19]

Raven et al.

[11] Patent Number: 5,991,959

[45] Date of Patent: Nov. 30, 1999

[54] TOOTHBRUSH WITH FLEXIBLY MOUNTED BRISTLES

[75] Inventors: Stephen John Raven, Nottingham; Derek Guy Savill, Cheshire, both of United Kingdom

[73] Assignee: Chesebrough-Pond's USA Co.,, Greenwich, Conn.

[21] Appl. No.: 09/024,814

[22] Filed: Feb. 17, 1998

[30] Foreign Application Priority Data

Feb. 17, 1997 [GB] United Kingdom ..... 9703274

[51] Int. Cl.[6] ..... A46B 7/06

[52] U.S. Cl. ..... 15/201; 15/167.1; 300/21

[58] Field of Search ..... 15/167.1, 110, 15/201; 300/21

[56] References Cited

U.S. PATENT DOCUMENTS

| | | | |
|---|---|---|---|
| 1,323,042 | 11/1919 | Gardner | 15/167.1 |
| 1,770,195 | 7/1930 | Burlew | 15/167.1 |
| 2,139,245 | 12/1938 | Ogden | 601/139 |
| 2,253,210 | 8/1941 | Psiharis | 601/139 |
| 2,706,825 | 4/1955 | Blakeman | 15/176.4 |
| 2,807,820 | 10/1957 | Dinhofer | 15/176.1 |
| 2,819,482 | 1/1958 | Applegate | 15/110 |
| 3,553,759 | 1/1971 | Kramer et al. | 15/110 |
| 4,472,853 | 9/1984 | Rauch | 15/167.1 |
| 4,691,405 | 9/1987 | Reed | 15/201 |
| 4,776,054 | 10/1988 | Rauch | 15/167.1 |
| 5,373,602 | 12/1994 | Bang | 15/167.1 |
| 5,524,319 | 6/1996 | Avidor | 15/167.1 |
| 5,651,158 | 7/1997 | Halm | 15/201 |

FOREIGN PATENT DOCUMENTS

| | | |
|---|---|---|
| 520692 | 1/1956 | Canada . |
| 0 613 636 | 9/1994 | European Pat. Off. . |
| 88569 | 7/1965 | France . |
| 09019323 | 1/1997 | Japan . |
| 438091 | 11/1934 | United Kingdom . |
| 92/17092 | 10/1992 | WIPO . |
| 92/17093 | 10/1992 | WIPO . |
| 92/17094 | 10/1992 | WIPO . |
| 94/05183 | 3/1994 | WIPO . |
| 95/30350 | 11/1995 | WIPO . |
| 96/02165 | 2/1996 | WIPO . |
| 97/07707 | 3/1997 | WIPO . |
| 97/14330 | 4/1997 | WIPO . |
| 97/20484 | 6/1997 | WIPO . |

*Primary Examiner*—Mark Spisich
*Assistant Examiner*—Theresa T. Snider
*Attorney, Agent, or Firm*—Milton L. Honig

[57] ABSTRACT

A toothbrush having a handle at one end thereof and a bristle bearing head, the head having a skeleton, a resilient member mounted on at least one side of the skeleton, tuft mounts in the skeleton and/or resilient member for receiving bristles, the resilient member bristle tufts being capable of toggling movement, the resilient member tuft mounts having an array of rigid receptacles or wells attached to the skeleton by a bridge hinge, characterised in that the bridge hinges are broken.

20 Claims, 8 Drawing Sheets

TOOTHBRUSH WITH FLEXIBLY MOUNTED BRISTLES

BACKGROUND OF THE INVENTION

1. Field of the Invention

The invention relates to a toothbrush having flexibly mounted bristles on the toothbrush head, and in particular to brushes having an elastomeric component and a non-elastomeric component.

2. The Related Art

Man has developed means of controlling microbially related diseases such as caries and periodontal disease by means of brushing. Whilst the main aim of toothbrushing is to remove plaque, excessive force or brushing frequency can lead to damage of the teeth or surrounding soft tissue. To remove plaque effectively, toothbrush filaments need to penetrate into the "v" shaped interproximal areas between the teeth to remove plaque with the minimum amount of force.

Conventional toothbrushes comprise bristles mounted in rigid head materials. The rigid head material provides support for the bristles.

The bristles are generally mounted on the toothbrush in a substantially upward orientation. Following use over a prolonged period the bristles tend to splay permanently outwards from the upward orientation whereupon the toothbrush is discarded and replaced.

However, it has been found that an improved cleaning operation can be performed with a toothbrush in which the bristles are splayed or adapted to splay in a controllable and repeatable manner. Accordingly, toothbrushes have been developed in which the toothbrush head is flexible to facilitate movement of the bristles in use. The flexible head is usually made up of jointed portions or segments which facilitate articulation of groups of bristles. Generally tufts can only flex in one direction/plane i.e. parallel to the plane defined by the longitudinal axis of the handle transverse to the aforementioned plane. However, a disadvantage of such segments is that unwanted foreign matter can accumulate in spaces between the segments and that individual tufts cannot articulate independently of one another, thereby reducing cleaning and plaque removal efficiency.

Bristles, particularly fine bristles, clean more efficiently when they penetrate effectively into the interproximal spaces between teeth and gums. Fine bristles can exhibit and enhance a splaying effect. In addition, we have found that fine bristles produce a more effective cleaning effect as they penetrate further into the interproximal spaces between the teeth and gums. However, it has been found that fine bristle tufts are particularly susceptible to excessive permanent splaying in use thereby reducing cleaning efficacy. Accordingly, rapid deterioration of the toothbrush results.

An object of the invention is to provide a toothbrush having a head with bristles mounted thereon in which the bristles mounted on the toothbrush head can repeatably and resiliently splay and move in a multidirectional manner to provide more effective cleaning.

SUMMARY OF THE INVENTION

According to the invention there is provided a toothbrush having a handle at one end thereof and a bristle bearing head, the head comprising a skeleton, a resilient member mounted to at least one side of the skeleton, tuft mounting means in the skeleton and/or resilient member for receiving bristles, the resilient member bristle tufts being capable of toggling movement, the resilient member tuft mounting means comprising an array of rigid receptacles or wells attached to the skeleton by a bridge hinge, characterised in that the bridge hinges are broken.

According to a further aspect of the invention, there is provided a toothbrush having a handle at one end thereof and a bristle bearing head, the head comprising a skeleton, a resilient member mounted to at least one side of the skeleton, tuft mounting means in the skeleton and/or resilient member for receiving bristles, the resilient member bristle tufts being capable of toggling movement, the tuft mounting means comprising an array of rigid receptacles or wells in which the bristle tufts are mounted. As such, the brush of the invention has bristles mounted in rigid receptacles or wells which are unattached to the skeleton, but are linked thereto by one or more resilient members.

According to yet a further aspect of the invention, there is provided a method of manufacturing a toothbrush having a handle at one end thereof and a bristle bearing head, the head comprising a skeleton, a resilient member mounted to at least one side of the skeleton, tuft mounting means in the skeleton and/or resilient member for receiving bristles, the resilient member bristle tufts being capable of toggling movement, the tuft mounting means comprising an array of rigid receptacles or wells in which, the bristle tufts are mounted, comprising providing the skeleton having attached thereto rigid receptacles or wells means by hinges, inserting bristle tufts into the rigid receptacles or wells, and subsequently breaking the hinges. The hinges may be broken before or after the resilient member is mounted onto the skeleton, though they are preferably broken after the resilient member is mounted on the skeleton.

Conveniently, in some preferred embodiments, the skeleton is a central one, and the resilient member a resilient side member, and is mounted on either side of the central skeleton, though it is envisaged that the skeleton may be the outer edges of the brush, and the resilient member may be centrally located in the brush, surrounding the resilient member.

In our co-pending application, British patent application no.9620092.8, the contents of which are incorporated by reference, we describe a variety of toothbrush configurations which comprise a toothbrush handle and head, the head having a central, relatively rigid central skeleton, wherein the bristles are generally mounted in a relatively resilient material surrounding the central skeleton. One of these configurations shows an array of bristle receiving receptacles or wells which are attached to the central skeleton by bridge hinges. We have now surprisingly found that an advantageous configuration of brush is attained if these bridge hinges are manufactured initially but are then subsequently broken or cut, in that the brush head is able to attain an increased amount of toggling movement in use, and thereby increase its cleaning efficiency. In spite of this, the brush as a whole still maintains its integrity.

In addition, the provision of bridge hinges initially in the brushing which are subsequently broken or cut has been found to provide advantages in terms of the manufacturing process, and in particular the efficiency of configuring the bristles into the brush head during manufacture (i.e. moulding) of the brush.

Toothbrushes according to the invention have a head with bristles mounted therein in which the bristles mounted on the toothbrush head can repeatedly and resiliently splay and move in all planes (upwards/downwards/sideways), herein referred to as "toggle". Such brushes have the bristles mounted in receptacles or wells which are not directly attached to the central skeleton, but instead are joined thereto by one or more resilient members.

Preferably, the resilient means comprises a resilient side member having a relatively low modulus of elasticity, mounted on a more rigid central skeleton, which has a relatively high modulus of elasticity. More preferably at least some of the bristles are tufts of bristles.

Preferably, the receptacles or wells in which the bristles are mounted are substantially surrounded or encased in the resilient side members.

Conveniently the skeleton is ellipsoidal. Suitably the skeleton is surrounded by the side members. More suitably, the side members further comprise at least one massaging protrusion, though an embodiment of the invention contemplates a brush in which the whole of the brush head is encapsulated in rubber, and thus acts as a "massaging protrusion" as a whole.

Advantageously the resilient means further comprises a resilient boot surrounding the bristles or tufts of bristles. Preferably the resilient means and the boots are integral to form a unitary resilient means and the resilient block and the boots comprise a rubber material.

In addition, a contemplated aspect of the invention is one in which several wells incorporating several tufts or collections of tufts may be joined together, for example being mounted together as a plate, with one or more hinges linking one or more plates in the head, with the hinges between the plates being subsequently broken to allow toggling between the plates. The result of this is a brush having bristle tufts mounted on plates which are not directly attached to the central skeleton, but which are linked thereto via a resilient member.

Conveniently the tufts of bristles comprise pear-shaped tufts.

BRIEF DESCRIPTION OF THE DRAWING

The invention will now be described having regard to the accompanying drawings in which.

DETAILED DESCRIPTION OF THE INVENTION

Figure 1:
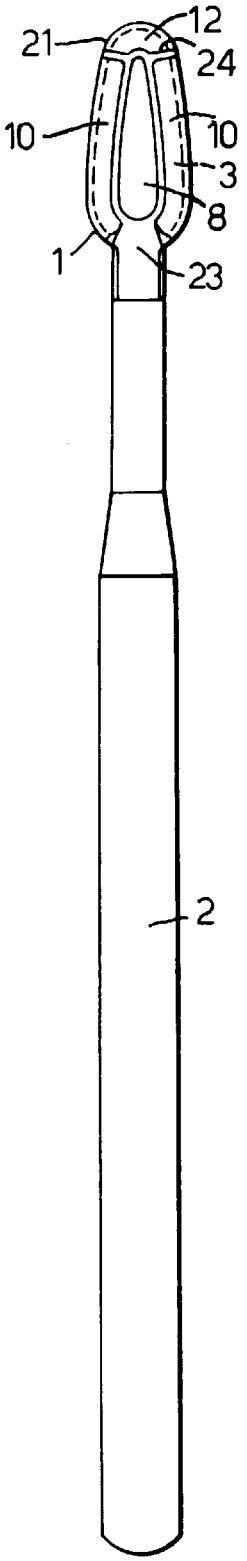
FIG. 1 is a top plan view of a first embodiment of a toothbrush of the invention showing the handle and toothbrush head with the bristles shown in broken lines.
Figure 2:
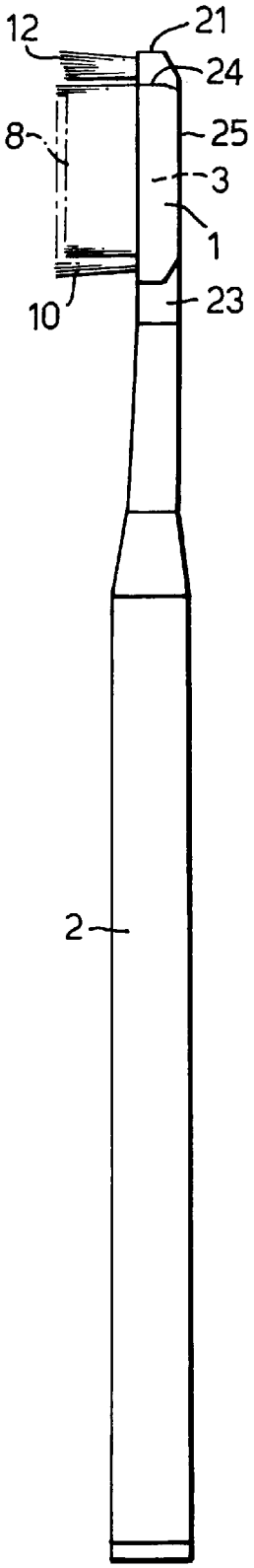
FIG. 2 is a side elevation of the toothbrush of FIG. 1.

As shown in FIGS. 1 and 2, the toothbrush is made up of a head (1) and a handle (2). The head (1) is mounted or internally moulded at one end of the handle (2) and is made up of an undercarriage-type skeleton (3) in which a resilient head block (25) (shown shaded) is disposed. The skeleton (3) has a narrow elongate ellipsoidal portion (23) which is a continuation of and integral with the handle (2). At the end remote from the handle (2), the skeleton (3) is expanded laterally outwards to define a semi-circular tip portion (24) in head tip (21).

The head block (25) is supported by the ellipsoidal portion (23) and the semi-circular tip portion (24). The head block (25) extends laterally outwards from i.e. stands apart from the ellipsoidal portion (23) and extends upwards from the ellipsoidal portion (23) to define two resilient side members (6). Therefore, the resilient side members (6) are not directly mounted on the skeleton (3) and hence have greater flexibility than the portion of the head block (25) which is mounted on the skeleton (3).

Figure 3:
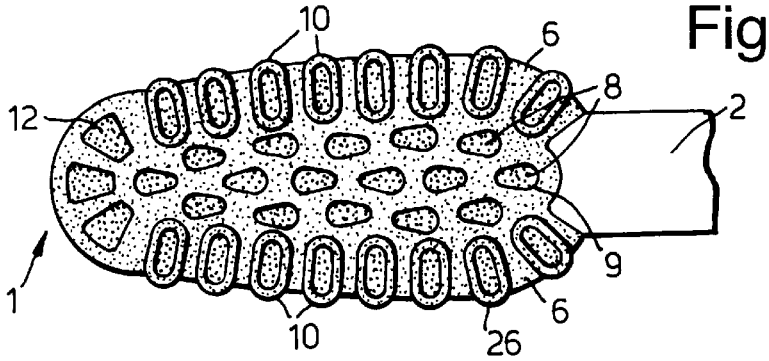
FIG. 3 is a top plan view of the first embodiment of a toothbrush head of the invention in which the peripheral arrays of bristles are booted.

The under carriage-type skeleton (3) increases the surface area of the head to facilitate bonding of the side members (6) to the head (1). The head block (25), when viewed from a top plan view as shown in FIG. 3, entirely covers the toothbrush head.

The head (1) is provided with a centre array of bristles (8) made up of substantially tear or pear-shaped bristle tufts (9) when viewed from above and two side arrays (10) either side of the centre array (8) made up of linear bristle tufts (11) disposed substantially perpendicular to the longitudinal axis of the handle (2). The semi-circular tip (24) is further provided with a tip array (12) of bristles having a substantially frustoconical outline when viewed from above as shown in FIG. 3.

The side array of bristles (10) are provided with boots (7) which extend upwards from the head block (25) and are moulded from the same resilient material. The linear tufts of the side arrays (10) are supported by the boots (7) and are restrained within the boot (7) by a bond between the resilient material of the head block (25) and the material of the bristles of the linear tufts (11).

The linear tufts (11) are made up of bristle filaments which can flex and splay outwards from the centre array (8) in use. Fine bristle filaments which can also be used enhance the splaying effect. The flexibility of the linear tufts (11) is further enhanced by the manner in which the resilient side members (6) stand apart from the under carriage skeleton (3).

However, due to the resilience of the side members (6) and of the boots (7), the linear tufts (11) return to their original positions following use and do not exhibit excessive splaying.

The bristles of the toothbrush head (1) can be secured in position and the toothbrush can be made using the methods and materials described in our co-pending British patent application no.96200892.8, the contents of which are incorporated herein by reference.

The toothbrush of the invention can also be assembled using standard technology known as anchor bar technology combined with moulding. For instance, the bristles or filaments can be attached to the head using said anchor bar technology combined with moulding. More particularly, the bristles or filaments can be attached to the head using said anchor bar technology and the resilient head block (25) moulded around the bristles. The anchor bar method is particularly applicable to mounting the bristles on the brush (e.g. in some embodiments those mounted on the central skeleton) which do not toggle.

In a highly preferred aspect of this invention, the toothbrush is manufactured by standard manufacturing techniques such as those described above, but then the assembled brush is subjected to mechanical shock to cause the bridging hinges which join the central skeleton to the array of rigid receptacles or wells in which the bristles are mounted to fracture, before the brush is commercially sold. Preferably, the hinges are cut or fractured before the resilient member (e.g. rubber) is moulded around the skeleton, to produce the finished brush.

Figure 4:
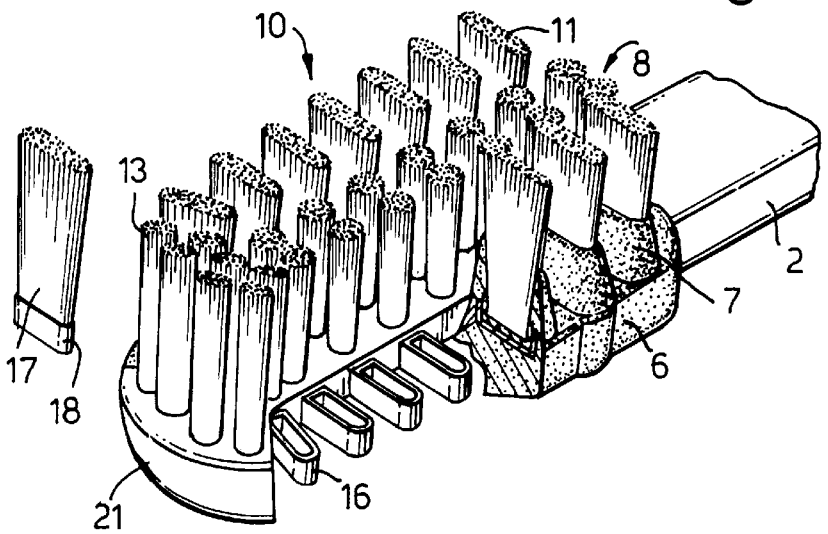
FIG. 4 is a perspective view of a second embodiment of a toothbrush head of the invention with the head partially cut away and a bottom sleeve removed for clarity, showing the hinges linking the central skeleton and the tuft mounting receptacles intact prior to breaking.

FIG. 4 shows a perspective view of another alternative embodiment of the invention similar to that shown in which the external figures in which the external appearance of the brush head is similar, but showing in more detail the internal configuration of the brush. In particular, the array of wells (16) in which the linear tufts (11) are mounted or captured is shown. In this present embodiment, the linear tufts (11) can be prefabricated to be easily inserted in the wells (16), which wells (16) are attached by hinges to the central skeleton, but which hinges can then be subsequently be broken.

The array of wells (16) is encased in the resilient side member material (6). The resilient side members (6) are also provided with boots (7) which support the linear bristle tufts (11).

The linear tufts (11) are formed individually to provide the prefabricated tuft (17). The bristles of the prefabricated tuft (17) are held together by a separate bottom sleeve (18), or by melting the individual bristles together in a controlled fashion.

FIGS. 5 to 15 show alternative arrangements of the external configurations of the centre, side and tip arrays (8), (10) and (12) respectively of the toothbrush head (1), the arrays being formed on the brush head according to the methods described above. The arrangement of the bristles in conjunction with the side members (6) provides an efficient toggling and hence cleaning effect due to the orientation of the surfaces defined by the free ends of the tufts.

Figure 5:
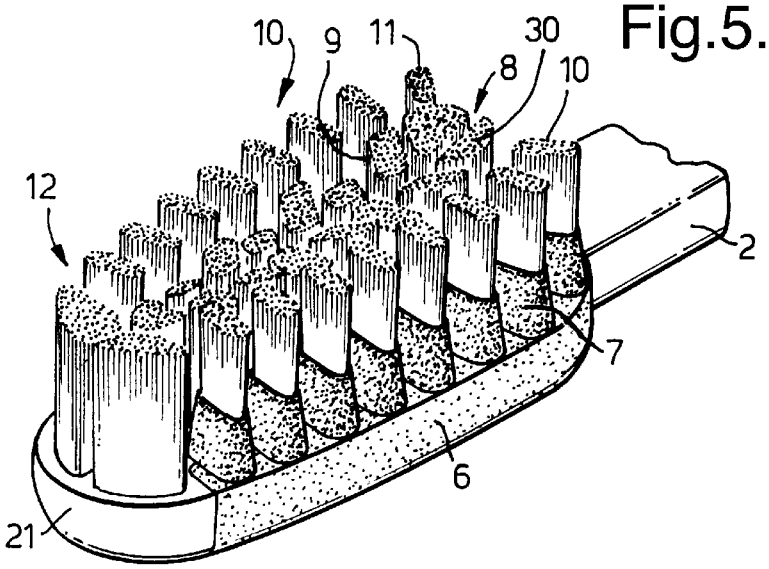
FIG. 5 is a perspective view of a third embodiment of toothbrush head according to the invention.

FIG. 5 shows a perspective view of an alternative toothbrush head of the invention similar to the embodiment shown in the earlier Figures, but with an alternative bristle array.

More particularly, the side arrays (10) are made up of linear tufts (11) as previously described which are supported by boots (7) while the tip array (12) is made up of tufts having a substantially frustoconical outline when viewed from above. The centre array (8) is made up of tufts (9) of bristles cut or shaped so as to define a series of tufts (9) whose free ends are cut/shaped to define alternating surfaces at their free ends to enhance the cleaning effect on the teeth. As shown in FIG. 5, the tufts (9) of bristles define top surfaces (30) of the tufts (9) which slope downwards towards the plane defined by the handle (2) in an alternating fashion.

Figure 6:
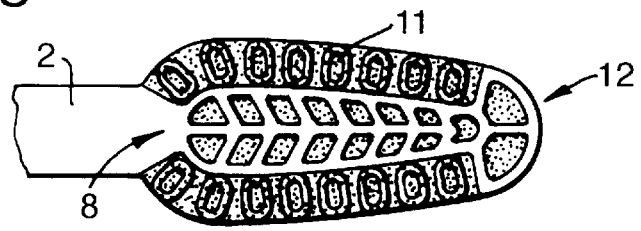
FIG. 6 is a top plan view of the toothbrush of FIG. 5.

FIG. 6 shows a top plan view of the toothbrush head of FIG. 5.

Figure 7:
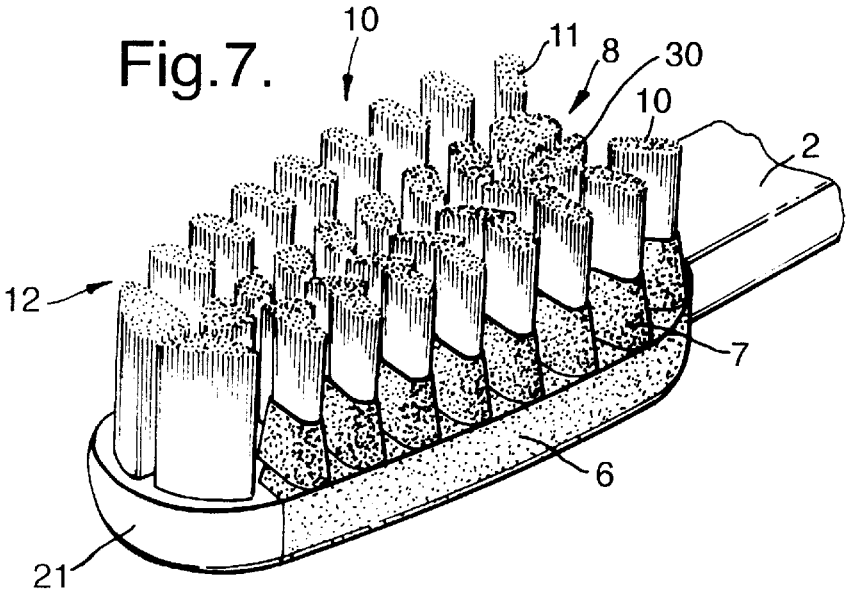
FIG. 7 is a perspective of a toothbrush head of the invention similar to that shown in FIG. 5 but having a further alternative tuft arrangement.

FIG. 7 shows a perspective view of an alternative arrangement of arrays (8, 10 and 12). The head is generally similar to the embodiment shown in FIG. 5 but while the centre array (8) have sloped top surfaces (30) of bristles similar to those described in FIG. 5 which do not alternate. More particularly, the surfaces (30) are sloped inwards towards the centre of the brush head.

FIG. 8 again shows a toothbrush similar to the embodiment described in FIG. 5 but with an alternative bristle arrangement. More particularly, the tip array (12) is provided with semi-circular tufts (31) which follow the outline of the toothbrush tip (21). The tufts (9) of bristles in the centre array (8) are substantially linear similar to the array of the side arrays (11) but in which the top surfaces (30) have been shaped/cut to define sloped surfaces.

Figure 8:
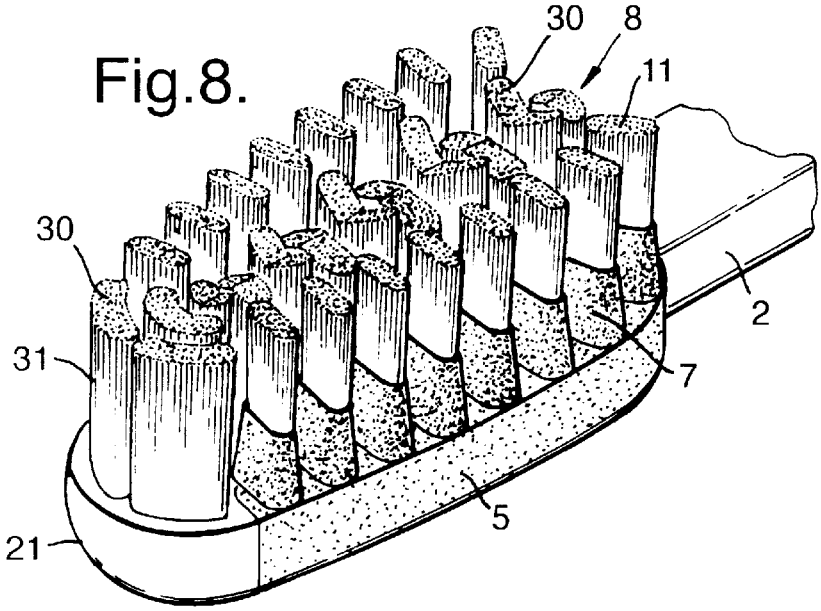
FIG. 8 is a perspective view of a toothbrush head of the invention similar to that shown in FIG. 5 but having another bristle tuft arrangement.
Figure 9:
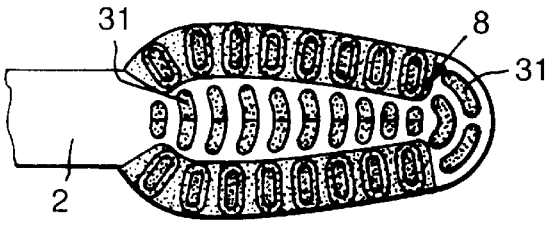
FIG. 9 is a top plan view of the toothbrush of FIG. 11.

FIG. 9 is a top plan view of the configuration of FIG. 8 and shows the semi-circular tip tufts (31). As shown in FIG. 9, the centre array (8) of tufts (9) is also made up of tufts which are slightly semi-circular in shape.

Figure 10:
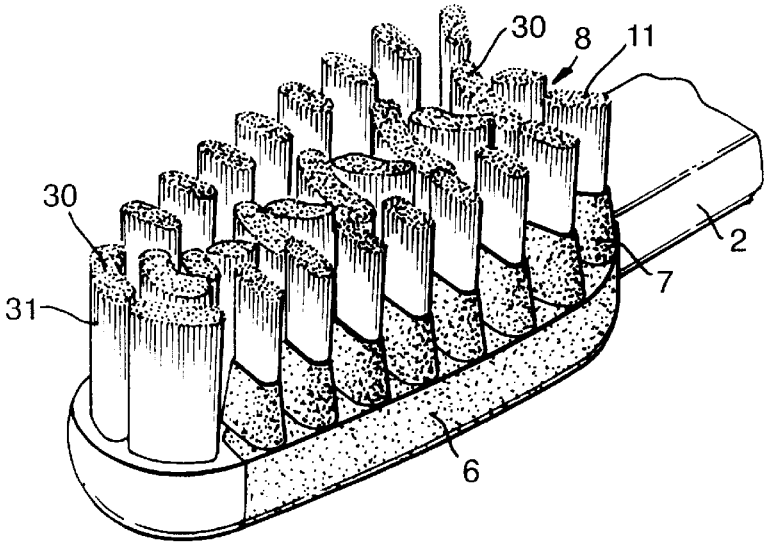
FIG. 10 is a perspective view of a toothbrush head of the invention again similar to that shown in FIG. 5, but with a further bristle tuft arrangement.

FIG. 10 shows a perspective view of yet another arrangement of array in which the centre array of bristles is again a linear tuft (9) but with the surfaces (30) of the tufts sloping in a curved fashion but in alternate directions.

Figure 11:
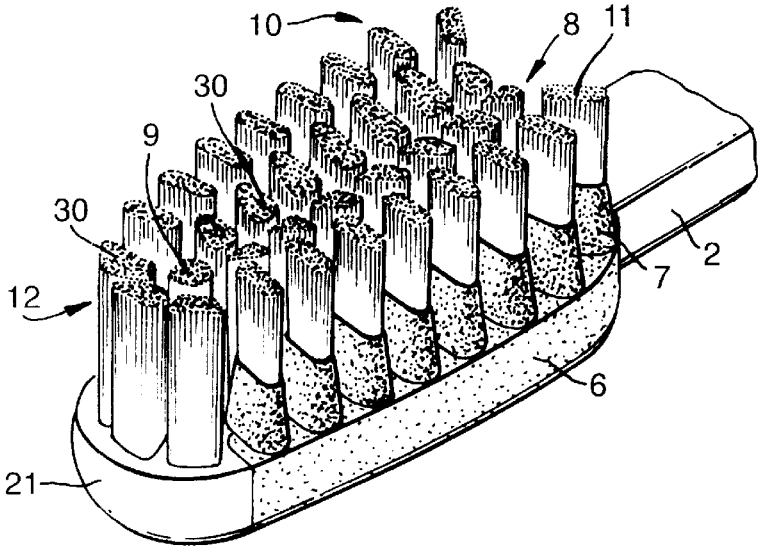
FIG. 11 is a perspective view of a toothbrush head of the invention similar to that shown in FIG. 5 but with yet a further alternative bristle tuft arrangement.

FIG. 11 shows a perspective view of a toothbrush head again similar to the embodiment shown in FIG. 5 but with yet a further arrangement of centre side and tip arrays (8, 10 and 12) respectively in which the top surfaces of the centre array (8) are sloped inwards towards the central longitudinal axis of the handle (2) while the tip tufts (12) are radially sloped inward towards the centre of the circular head tip (21) and is provided with a circular tuft (9) of bristles between the tip tuft (12) and the centre array (8).

Figure 12:
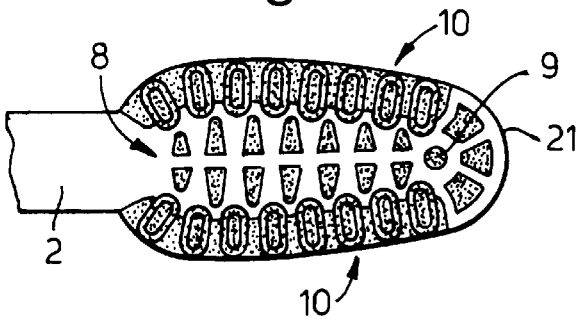
FIG. 12 is a top plan view of the toothbrush of FIG. 11.

FIG. 12 more clearly illustrates the circular tip tuft described in relation to FIG. 11.

Figure 13:
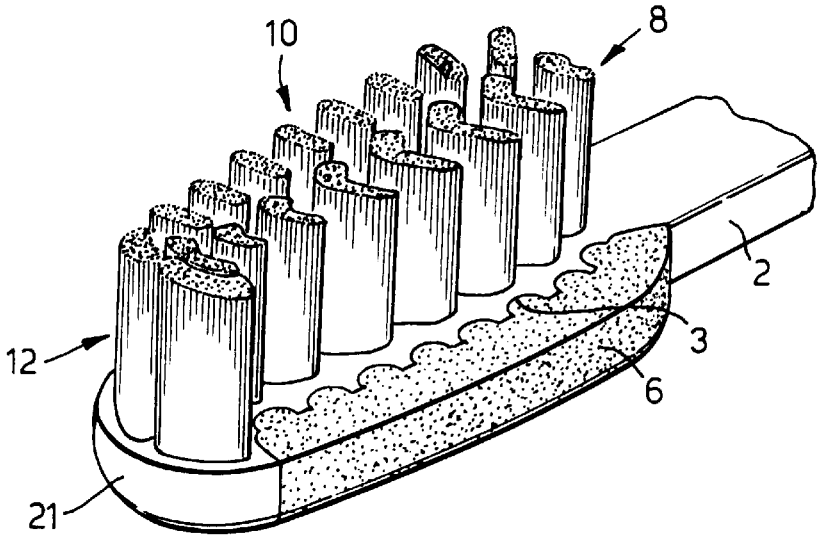
FIG. 13 is a perspective view of a toothbrush head of the invention similar to that shown in FIG. 5 but with another bristle tuft array and with a portion of the peripheral array omitted for clarity.
Figure 14:
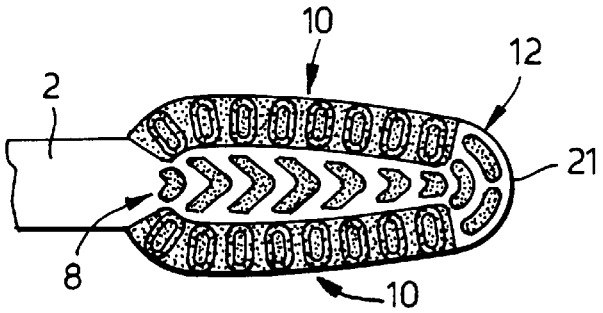
FIG. 14 is a top plan view of the toothbrush of FIG. 13.

FIG. 13 shows a perspective view of a toothbrush head of the invention similar to that shown in FIG. 5 but with another bristle tuft arrangement and with a portion of the peripheral array omitted to more clearly illustrate the centre array (8). The head (1) of this embodiment is moulded in the form of a skeleton (3) as previously described. The interface between the head (1) and the resilient side members (6) is interlocking to increase the surface area of the head (1) to facilitate bonding to the side members (6). The centre array (8) is made up of substantially V-shaped tufts when viewed from above as shown in FIG. 14.

Figure 15:
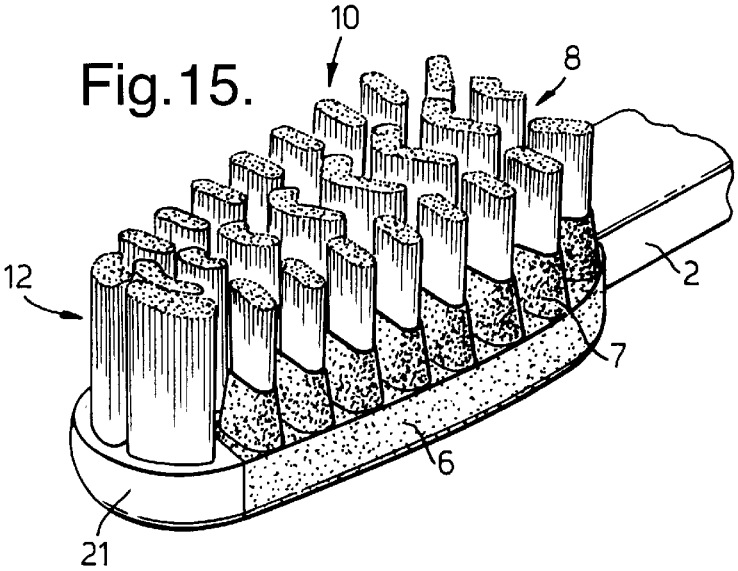
FIG. 15 is a perspective view of the toothbrush head of FIG. 13 with the peripheral array of bristles in place.

FIG. 15 shows a perspective view of the toothbrush head of FIG. 13 in which the complete array of bristles is shown.

Figure 16:
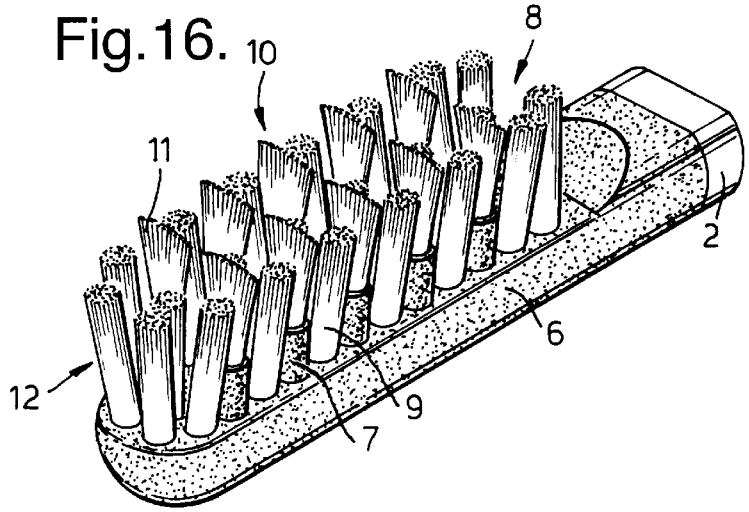
FIG. 16 is a perspective view of an alternative embodiment of a toothbrush head of the invention having booted peripheral bristle tufts and unbooted tufts in a rubber encased head.

FIG. 16 shows an alternative embodiment of the invention in which the head (1) is entirely encased in resilient material such that the skeleton (3) as described in FIG. 10 is not visible. The side arrays (10) are made up of circular tufts (9) of bristles. The circular tufts (9) are alternated with tufts of fine fanned linear tufts (11) and thicker circular tufts. The fine linear tufts of bristles (9) are provided with boots (7) to support the bristles as previously described.

Figure 17:
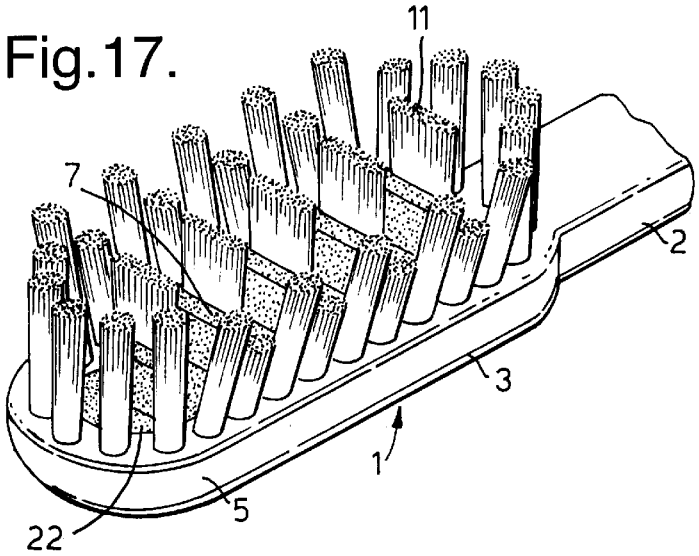
FIG. 17 is a perspective view of yet another embodiment of a toothbrush head of the invention having a booted centre array of bristles.

FIG. 17 shows an alternative embodiment of the toothbrush of the invention in which the centre array (8) of bristles is made up of linear tufts (11). The centre array of bristles (8) is embedded in a central island (22) of flexible resilient material such as rubber, whilst at the same time being supported in underlying wells or receptacles which were once attached to the relatively rigid side walls of the brush by flexible hinges, but with these hinges subsequently being broken. The linear tufts (11) of the centre array (8) are provided with boots (7) as previously described. The bristles of the centre array (8) can be made up of coarse or fine bristles as described above.

Accordingly, the centre array (8) is made up of splayable bristles which can toggle in a multidirectional manner while the outer side arrays (10) are mounted in a frame similar to bristle tufts of the prior art.

The above mentioned features of the invention, namely the flexible side members (6) and the use of fine bristles together with boots (7) located in receptacles or wells which were once connected to a rigid central skeleton by flexible hinges, but in which the hinges are subsequently broken, provides a self-adjusting tuft design to deliver effective brushing, with the toggling effect being enhanced by the underlying structure of the brush which features broken hinge arrangements between the receptacles or wells which support the bristle tufts, and the central skeleton.

The side linear tufts (11) of the side array (10) can in some embodiments be supported by the flexible boots (7). Generally, the bristle tufts of the side arrays (10) can be 50% narrower than conventional bristle tufts such that the bristles will spread or splay with ease as they meet resistance against teeth in use. Such automatic fanning of the bristles is facilitated by the broken hinges between the receptacles or wells and the central skeleton, and facilitates deeper gum line and interproximal penetration without the high forces and discomfort that are experienced with traditional geometries. The flexible rubber boots reinforce the bristles to offset the relative softness of the bristles to provide a resilient memory which preserves the tuft shape.

The mounting of the tufts of bristles in receptacles or wells attached to the skeleton by subsequently broken hinges, together with the boots (7) on the side member (6) allow individual tufts (9) to independently flex and adjust to the irregular dental topography.

Therefore, the combination of flexing of the boots (7) and the side member (6), together with the "broken hinge" arrangement, or indeed an arrangement in which the tufts are mounted in receptacles which are not attached to the central skeleton, lowers the point at which the tufts bend to the head thereby creating a longer lever arm that results in a toggle effect that ensures that bristles remain in crevices longer for superior plaque removal. Accordingly, the bristles can adjust in all directions to ensure continuous bristle contact in the complex architecture of the teeth and gums.

The alternating surfaces and shapes of the centre array of bristles (8) facilitate the removal of plaque from the triangular spaces between adjoining teeth and broad tooth surfaces. The alternating surfaces and the tear drop shaped tufts as shown in FIG. 3 for example provide each tuft with two cleaning actions that work simultaneously and deliver a dynamic action when downward force and horizontal pressure is applied to the brush head. The narrow long side of the array (8) deeply penetrates the spaces between the teeth while the wide short side of the tear drop shape or pear shape offers increased stiffness maximising the cleaning contact with the tooth. The individual movement potential of the tufts facilitate contact by the individual tufts to multiple tooth surfaces without being pushed away or structurally supported by adjacent tufts.

The tip tufts (12) are suitably made of dense tufts of bristles which are configured radially at the tip (21) of the brush and are comparably more narrow than the other tuft groups on the brush head. The tapered nature of the ellipsoidal shaped brush head allows for increased rear molar access. Moreover, the elastomeric rubber tip as shown in FIG. 3 and the elastomeric wings of side member (6) of the brush head act as a soft bumper to increase comfort while accessing tight often ignored areas of the mouth. The radially sloped trim of the tip tufts provide superior reach and bristle tips maximising plaque removal on the back sides of rear molars.

An advantage of the toothbrushes of the invention is that the use of separately moveable tufts on the outer edge of the brush head having soft flexible rubber holders containing fine filaments facilitates access to previously inaccessible areas of the tooth. The mounting of such moveable tufts in receptacles or wells which are not attached to the skeleton may accentuate this benefit.

The arrangement ensures that the bristles are surface sensitive in that each tuft of bristle moves independently in an upward/downward direction, responding to the changing contour of teeth. This enables the toothbrush bristles to penetrate and remove plaque from difficult to reach places in which plaque bacteria are to be found.

The use of top surfaces of bristles at different angles further improves the cleaning performance as the teeth are therefore scrubbed from different angles.

The bristle filaments can be manufactured from standard bristle materials such as nylon and polyester and can be extruded. A single brush can have filaments manufactured from a combination of such materials.

The head (1) of the toothbrush of the invention can also be detachable from the handle to provide a toothbrush having interchangeable heads.

Figure 18:
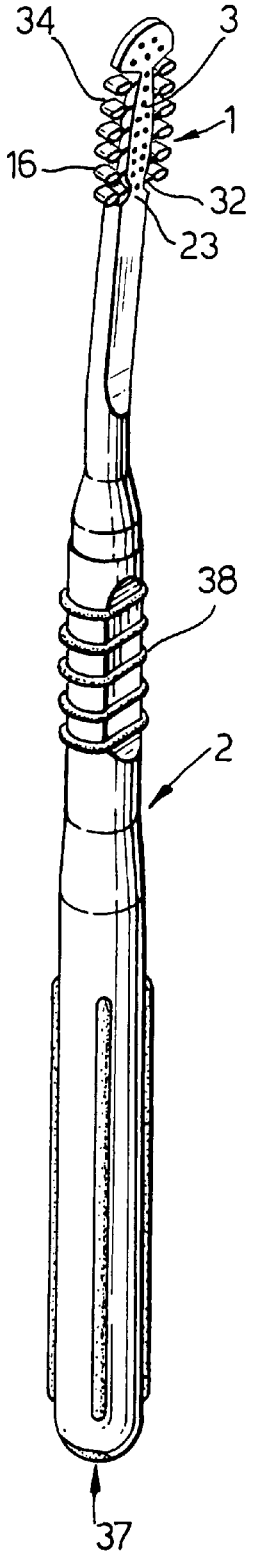
FIG. 18 is a perspective view of a further embodiment of a toothbrush of the invention with the skeleton and tuft mounting receptacles intact, prior to being encased in resilient material.
Figure 19:
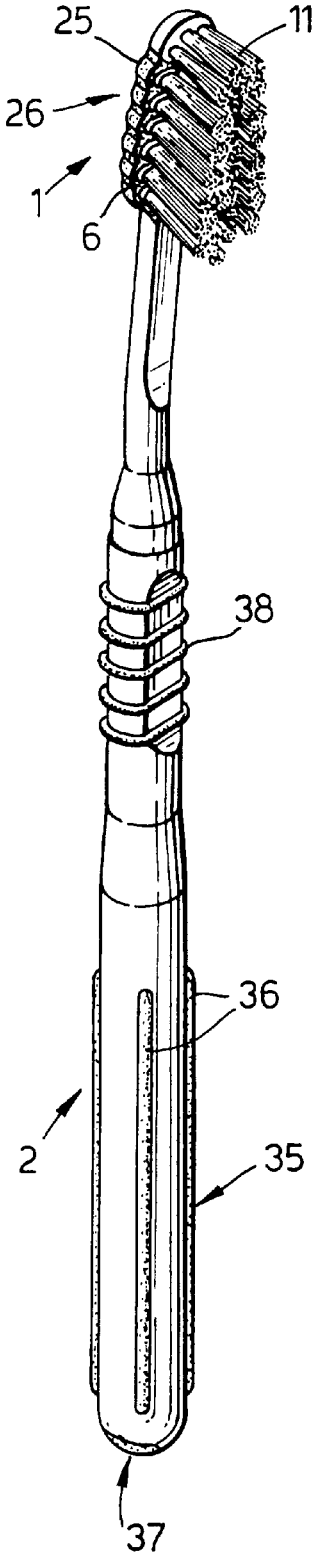
FIG. 19 is a perspective view of the toothbrush of FIG. 18 with the skeleton encased.

FIGS. 18 and 19 show the same brush, with FIG. 18 showing the relatively rigid "core" of the brush, minus the resilient side members and the bristles, from which the brush according to the invention may be made. The brush has a head and handle as previously described.

The head is made up of an array of wells (16) flexibly attached to the skeleton on either side. Bristle tufts are mounted in openings in the central skeleton and in the well, the central skeleton being sufficiently thick or wide to accommodate tufts. However, in the present embodiment the wells are attached to the skeleton (3) by flexible hinges (32). The hinges are formed from the same material as the skeleton (3). The hinges (32) define hinges or pivot points which can subsequently be broken once assembly of the brush is complete, to allow the wells (16) extra capacity to toggle in a multidirectional manner.

Bristle tufts (11) are moulded into the wells (16) as previously described. The wells (16) are spaced apart by gaps (34). The gaps (34) facilitate the flexing/splaying or toggling of the wells (6) along the brush head once the hinges are broken.

The exact configuration of the central skeleton, wells and hinges is selected so as to facilitate the breaking of the hinge after manufacture. In some embodiments this may require the hinges to be as long and thin as possible. A preferred minimum hinge diameter is in the region 0.3×0.3 mm for a hinge of length 0.5 mm and rectangular cross section. Greater hinge flexibility, and hence the ability to snap the hinge, can be obtained if the hinge is relatively long, i.e. in the region of 1 mm length.

The wells (16) are surrounded by the resilient side member material (6) to define undulating/massaging surfaces (26). The massaging surfaces (26) impart a desirable massaging effect to a user's gums, mouth and teeth in use.

In this embodiment the handle is also provided with a resilient material in the form of a gripping portion remote from the brush head comprising four longitudinal gripping bars (36) forming a gripping bar array (35) parallel to the longitudinal axis defined by the handle. The gripping bars are made of the resilient material and protrude from the surface of the gripping portion of the handle to facilitate gripping in use.

In addition, the gripping portion is provided with an end grip (37) at the end of the handle, remote from the brush head (1). The end grip is also manufactured from the resilient material, and typically enhances grip of the brush in the palm region in use.

The handle of the brush has five thumb grips (38), intermediate the brush head (1) and the gripping bars (36). The thumb grips (38) are also manufactured from the resilient material and protrude from the handle (2) surface, and extend transverse to the longitudinal axis defined by the handle (2).

Figure 20:
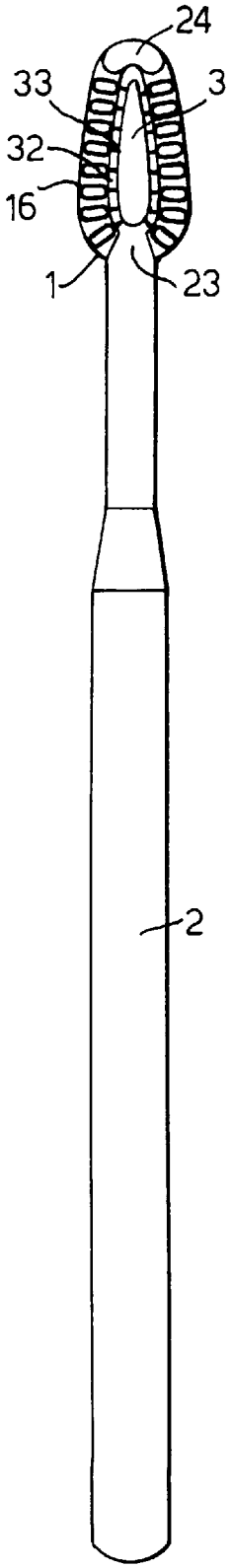
FIG. 20 is an enlarged view of the toothbrush skeleton focusing on the broken bridge hinge.

FIG. 20 illustrates in a cutaway view wells (16) spaced apart by gaps (34). Flexible bridge hinges (32) originally connecting wells (16) to skeleton (3) are broken therefrom at break (33).

We claim:

1. A toothbrush having a handle joined thereto and a bristle bearing head, the head comprising a skeleton, a resilient member mounted on at least one side of the skeleton, tuft mounting means in at least one of the skeleton and resilient member for receiving bristles, the tuft mounting means being capable of toggling movement and comprising an array of rigid receptacles or wells wherein the rigid receptacles or wells are not attached to the skeleton but are linked thereto by the resilient member.

2. A toothbrush according to claim 1, wherein the skeleton is central, and the resilient member is a resilient side member, being mounted on either side of the central skeleton.

3. A toothbrush as claimed in claim 2, wherein the skeleton comprises a material having a higher modulus of elasticity than the modulus of elasticity of the side member.

4. A toothbrush as claimed in claim 1, wherein the resilient member comprises a resilient support block mounted on the skeleton, the skeleton being more rigid than the support block.

5. A toothbrush as claimed in claim 1, wherein the array of receptacles or wells are substantially surrounded by the resilient member.

6. A toothbrush as claimed in claim 1, wherein at least some of the bristles are tufts of bristles.

7. A toothbrush as claimed in claim 6, wherein the resilient member further comprises a resilient boot surrounding the bristles or tufts of bristles.

8. A toothbrush as claimed in claim 7, wherein the resilient member and the boot are integral to form a unitary resilient member.

9. A toothbrush as claimed in claim 7, wherein the bristles mounted in the boot comprise fine bristles.

10. A toothbrush as claimed in claim 7, wherein the resilient member and boot comprise a rubber material.

11. A toothbrush as claimed in claim 1, wherein the skeleton comprises a material having a modulus of elasticity which is higher than the modulus of elasticity of the resilient member.

12. A toothbrush as claimed in claim 1, wherein the resilient member is mounted on the skeleton and stands laterally apart from said skeleton.

13. A toothbrush as claimed in claim 12, wherein the skeleton is a frame which surrounds the resilient member.

14. A toothbrush as claimed in claim 13, wherein the skeleton is provided with a multiplicity of through holes for receiving bristle tufts.

15. A toothbrush as claimed in claim 14, wherein the skeleton comprises an array of rigid receptacles for receiving the bristle tufts.

16. A toothbrush as claimed in claim 14, wherein the tufts of bristles comprise tear-shaped tufts.

17. A toothbrush as claimed in claim 13, wherein the skeleton comprises wells for receiving bristle tufts.

18. A toothbrush as claimed in claim 1, wherein the skeleton comprises a material selected from the group consisting of polypropylene and nylon.

19. A method of manufacturing a toothbrush, the toothbrush comprising:

a handle joined to a bristle bearing head, the head comprising a skeleton, a resilient member mounted on at least one side of the skeleton, tuft mounting means in at least one of the skeleton and resilient member for receiving bristles, the tuft mounting means being capable of toggling movement and comprising an array of rigid receptacles or wells attached to the skeleton by at least one bridge hinge;

the method comprising:

inserting bristles tufts into the array of rigid receptacles or wells; and breaking the at least one bridge hinge.

20. The method according to claim 19 further comprising molding the resilient member around the skeleton.

* * * * *